US006074305A

United States Patent [19]

Schnapp

[11] Patent Number: 6,074,305

[45] Date of Patent: Jun. 13, 2000

[54] IMPLEMENT FOR PLAYING, WALKING AND TRAINING

[76] Inventor: Abraham Schnapp, P.O. Box 5496, Haifa, 31054, Israel

[21] Appl. No.: 09/275,461

[22] Filed: Mar. 24, 1999

[51] Int. Cl.[7] ..... A63G 1/12

[52] U.S. Cl. ..... 472/15; 472/26; 280/206

[58] Field of Search ..... 472/15, 21, 22, 472/25, 26; 104/78, 77; 280/205, 206, 207; 482/74, 78; 434/255

[56] References Cited

U.S. PATENT DOCUMENTS

| | | | |
|---|---|---|---|
| 724,672 | 4/1903 | Culver | 280/206 |
| 4,146,245 | 3/1979 | Ben-Zwie | 280/206 |
| 4,302,006 | 11/1981 | Johnson | 472/28 |
| 4,401,314 | 8/1983 | Zimmerman | 280/206 |
| 5,243,224 | 9/1993 | Tagney, Jr. | 482/78 X |

*Primary Examiner*—Kien T. Nguyen
*Attorney, Agent, or Firm*—Frishauf, Holtz, Goodman, Langer & Chick, P.C.

[57] ABSTRACT

An implement to be used as a plaything by children and as training equipment by grownups, includes a hoop of a diameter larger than the height of a person standing on its inside surface and treading forwards with the aim to roll the hoop along a floor surface. A chassis frame is slidingly attached to the two lateral edges of the hoop. The chassis frame supports a front wheel and a steering handle extending towards the hands of the person in the hoop. Treading on the hoop's inside surface propels the hoop along the floor while the front wheel is steered by the user. A hoop sized for adults can be used as a training implement by mounting it in rotatable alignment on a stationary base. The training implement may be configured for use in various positions, either upright, or when sitting and even while laying down.

17 Claims, 9 Drawing Sheets

IMPLEMENT FOR PLAYING, WALKING AND TRAINING

BACKGROUND OF THE INVENTION

The invention relates to an implement for playing, walking and training in the shape of a hoop standing on edge and rotated by a person treading along its inside circumference. It relates particularly to a children's plaything allowing a child to move the hoop forward in any direction in a dwelling or on the pavement.

Children love playthings on which they can ride and move about, and there exist many implements for this purpose, such as roller skates, roller boards and the like which, however, demand a certain amount of skill and may cause injury to a child falling off. The present implement, on the other hand, is designed for children of any age who should enjoy moving about in a kind of vehicle which can be steered in any direction without requiring special skill or training.

PRIOR ART

DE 1703202.9 discloses a sport article in the shape of a large inflatable loop made of an impervious material. It is provided with external fins that permit its motion on a sheet of water caused by a person walking along its inside.

SU 1284-567 describes a stationary rotatable drum adapted to be rotated by a person standing on top of the drum. Inside the drum are two cabins, each accommodating a person, while each cabin is additionally rotated about the drum center by bevel gears.

SU 1284-569 describes training equipment in the shape of two rings connected by bars and netting. The equipment is stationary and rotatable by a person operating a crank.

It is the main object of the present invention to provide an implement which will allow a child to move about in he home, the garden and on the sidewalk while changing direction, without causing damage to the property or injury to the child.

It is another object to provide the implement in the form of separate components to be readily assembled for use and to be stored in a small place in disassembled state.

Still another object is to provide the implement in a form and shape permitting ready cleaning and rinsing of all parts.

It is another object to construct the implement in different sizes for younger or older children, or for adults.

And it is a final object to utilize most of the components for assembly of an implement suitable for training and strengthening the legs of adults and children alike.

SUMMARY OF THE INVENTION

The playing and training implement of the invention includes a hoop of a diameter larger than the height of a child standing on its inside surface and treading forwards with the aim to rolling it along the floor surface. It further includes a chassis frame slidingly attached to the two lateral edges of the hoop in at least four points and supporting a front wheel attached to the lower end of an upright axle which is mounted in the chassis frame and configured to be turned by at least one steering handle extending towards the hands of the child. By treading along the hoop's inside surface the child moves the hoop along the floor while the front wheel rests on the ground and is steered by the child's turning it about the desired angle with the aid of the steering handle. In a preferred embodiment the hoop includes two outwardly extending lateral edges while the portion between these edges is in lattice shape in order to lighten its weight and to allow dirt to penetrate to the ground. Fastening of the chassis frame is by means of at least four rollers or other bearings sliding in circular recesses entering the hoop from both sides. As an alternative eight bearings hug the hoop edges from inside and outside, likewise permitting rolling movement of the hoop while the front wheel remains on the ground.

In order to permit easy storing of the implement when not in use, the hoop is preferably composed of several sections which can be readily assembled by swallow-tailed connections.

The hoop itself can be used as a training implement, preferably for adults, by mounting it in rotatable alignment on a stationary base. It will be understood that in the case of use with adults its diameter will be large enough to accommodate the person. Connection between hoop and base can be made by roller bearings entering lateral circular recesses or by horizontal rollers supporting the hoop in several points.

DETAILED DESCRIPTION OF THE DRAWINGS

Figure 1:
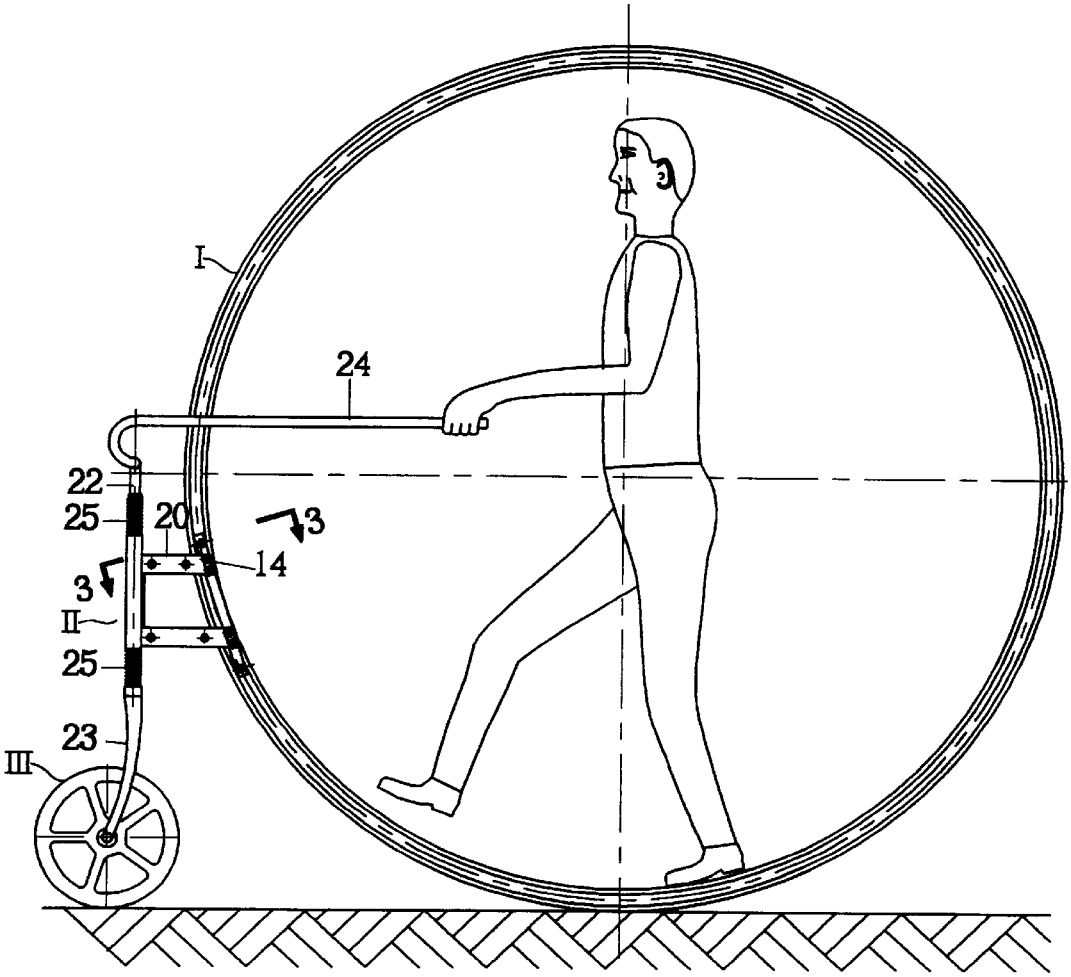
FIG. 1 is a side view of the implement for the use of children.
Figure 2:
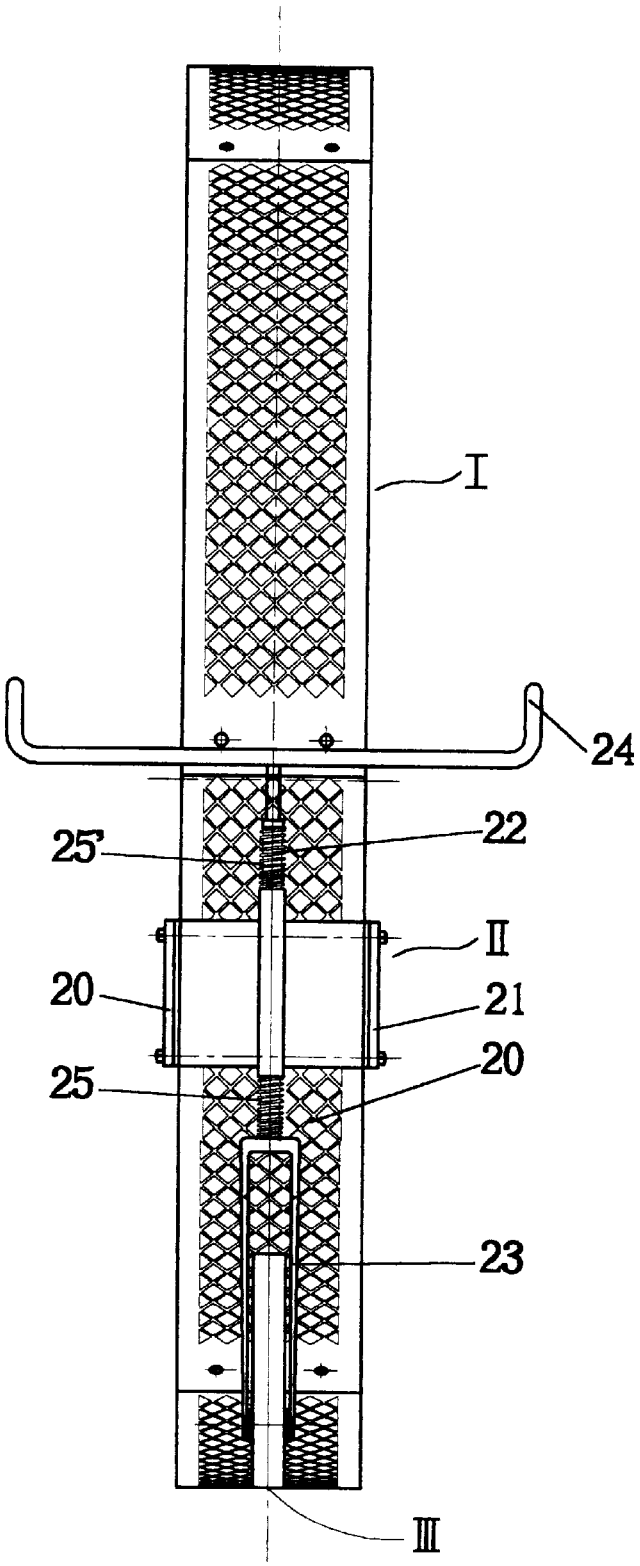
FIG. 2 is a front view of the implement of FIG. 1.
Figure 3:
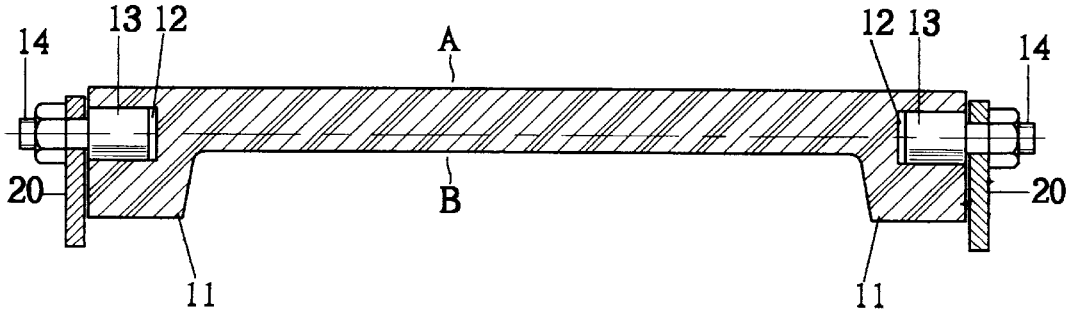
FIG. 3 is a section along line 3—3 of FIG. 1.

With reference to FIGS. 1, 2 and 3 an implement for a child according to the invention includes a hoop I of a diameter large enough to accommodate a child standing upright and treading on the inside surface of the hoop shown as A in FIG. 3. It further includes a chassis frame II slidingly attached to the hoop and carrying a front wheel III. The hoop is of a width allowing a person to tread on its inside surface with his two feet and includes a central, relatively thin portion 10 and two lateral portions 11 of greater width which are in contact with the ground, while the central portion remains remote from the ground. Two circular recesses 12 enter the lateral portions from both sides respectively and serve to accommodate at least four roller bearings 13 (two being shown in the drawing) which support the chassis frame in sliding attachment. FIG. 3 illustrates the shafts 14 supporting the roller bearings and side walls 20 of the chassis frame holding the shafts.

The chassis frame II is composed of two sets of struts 20 and 20' each set being interconnected by a horizontal bolt 21 at a distance somewhat greater than the width of the hoop thus hugging the latter on both sides. The chassis is slidingly fastened to the hoop by four roller bearings attached to the struts by bolts 14, which slide around the hoop in circular recesses 12. An upright axle 22 is rotatably mounted in the chassis frame and terminates at its lower end in the form of a fork 23 which encloses front wheel III. Two steering handles 24 are attached to the top of axle 22 and extend in rearward direction to the hands of the child around the two lateral edges of the hoop. Springs 25 and 25' serve to buffer the shocks caused by unevenness of the road and prevent their transmission to the hands of the person riding the implement.

Figure 4:
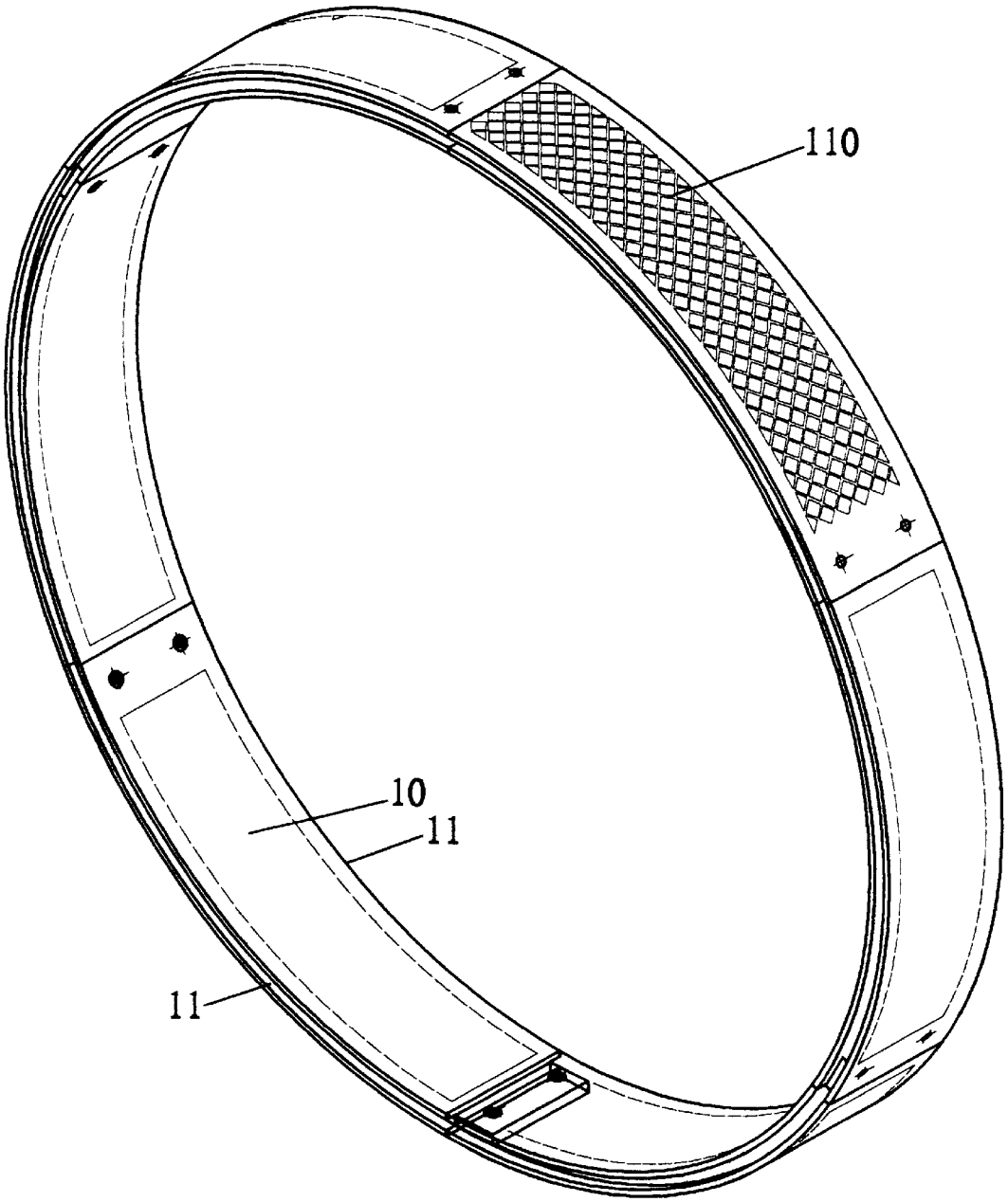
FIG. 4 is an isometric view of the hoop composed of six sections.
Figure 5B:
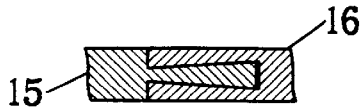
FIGS. 5*b*, 5*c*, 5*d* and 5*e* are details of FIG. 5*a,*
Figure 5C:
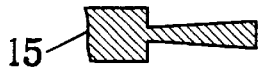
Figure 5D:
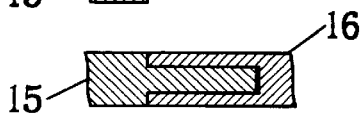
Figure 5E:
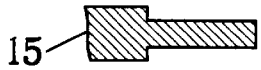
Figure 5A:
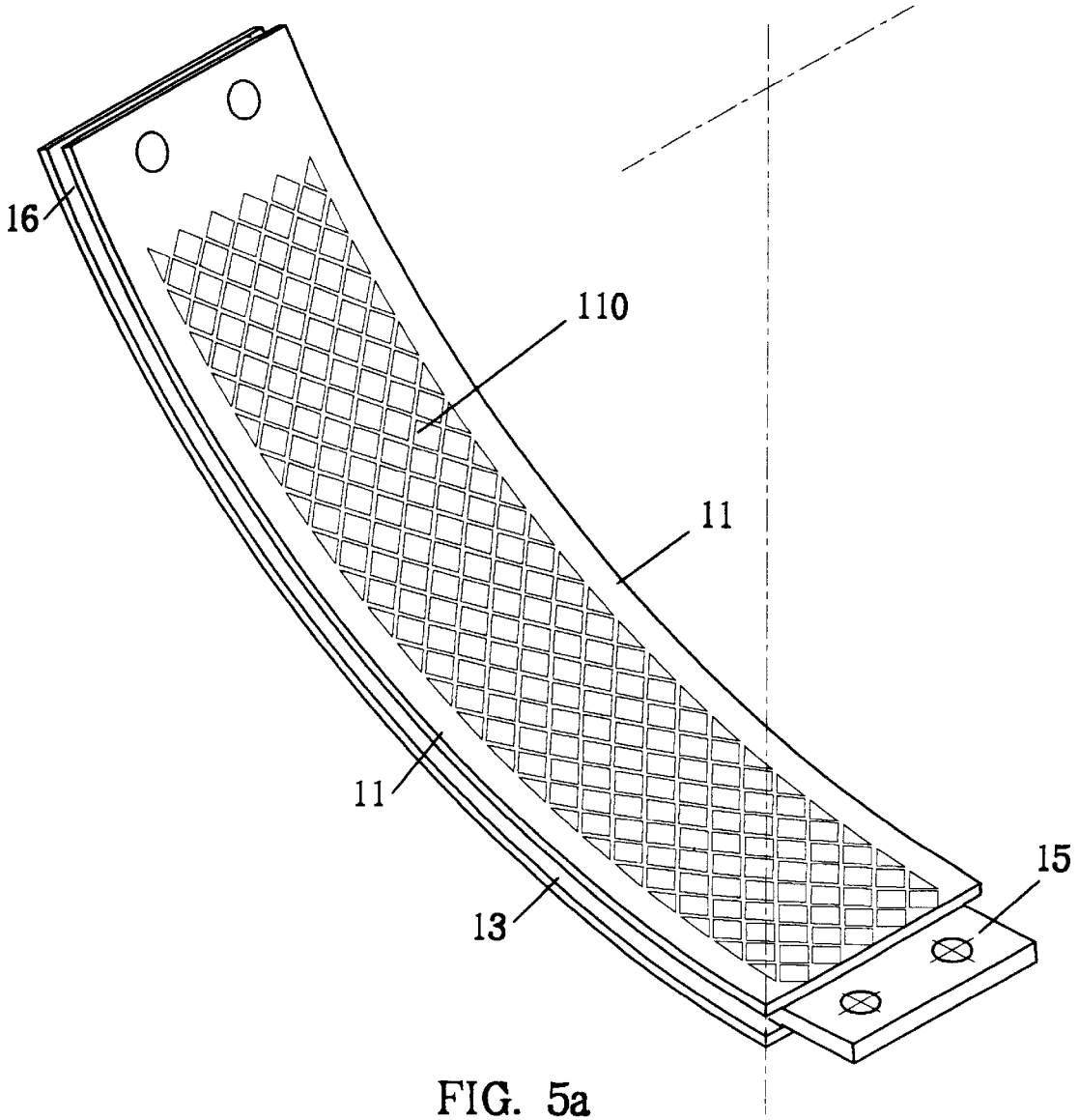
FIG. 5*a* is an isometric view of one section of the hoop.

In order to save space while storing the implement, the hoop is preferably composed of sections, for instance of six sections as shown in FIGS. 4 and 5*a*, but any other number may be suitable. The central portion may be solid as shown in regard to five sections (10 in FIG. 4), or may be perforated in lattice form (110) for the sake of lightening the hoop and to permit dirt from shoes to pass through to the ground. Connection between each two sections is by swallow tails 15 at one end and a tapering slot 16 at the other end of each section. In a manner known to the art the swallow tail of each section is pushed sideways into the tapering slot of the adjoining section. A first example of a connection between two sections, 10 or 110, is presented in FIG. 5*b* as a cross-section of the end parts of two sections. A swallow tail 15 shown in FIG. 5*c* is engaged laterally with a correspondent negative slot 16. Another connection example is depicted in FIG. 5*d*, where a parallel swallow tail 15, shown in FIG. 5*e*, engages an appropriate slot 16.

Figure 6:
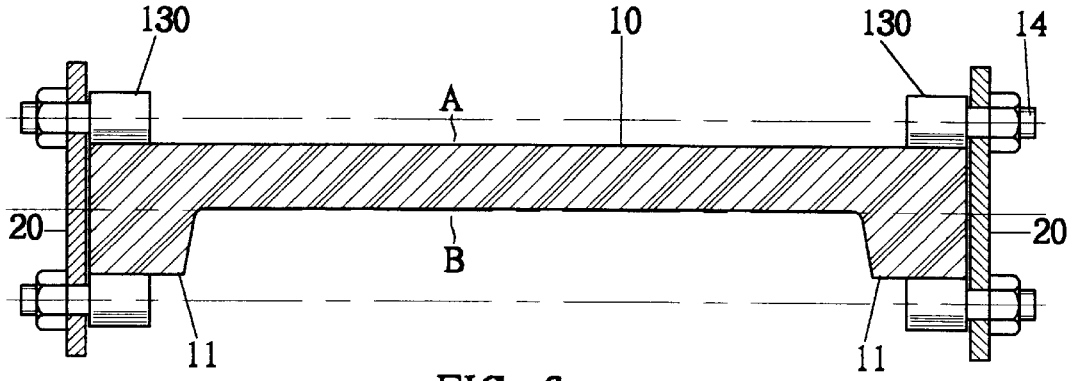
FIG. 6 is a section similar to the section of FIG. 3, illustrating an alternative connection of the chassis frame to the hoop.

The section shown in FIG. 6 illustrates a second manner of slidingly connecting the chassis frame to the hoop: Herein two opposed roller bearings or rollers 130 hug the side portions 11 of the hoop from inside and outside, shown respectively as A and B in FIG. 6, instead of the arrangement of one roller entering recess 12 (FIG. 3). The rollers or bearings are attached to the chassis frame by bolts 14 as in the aforedescribed embodiment.

Figure 7:
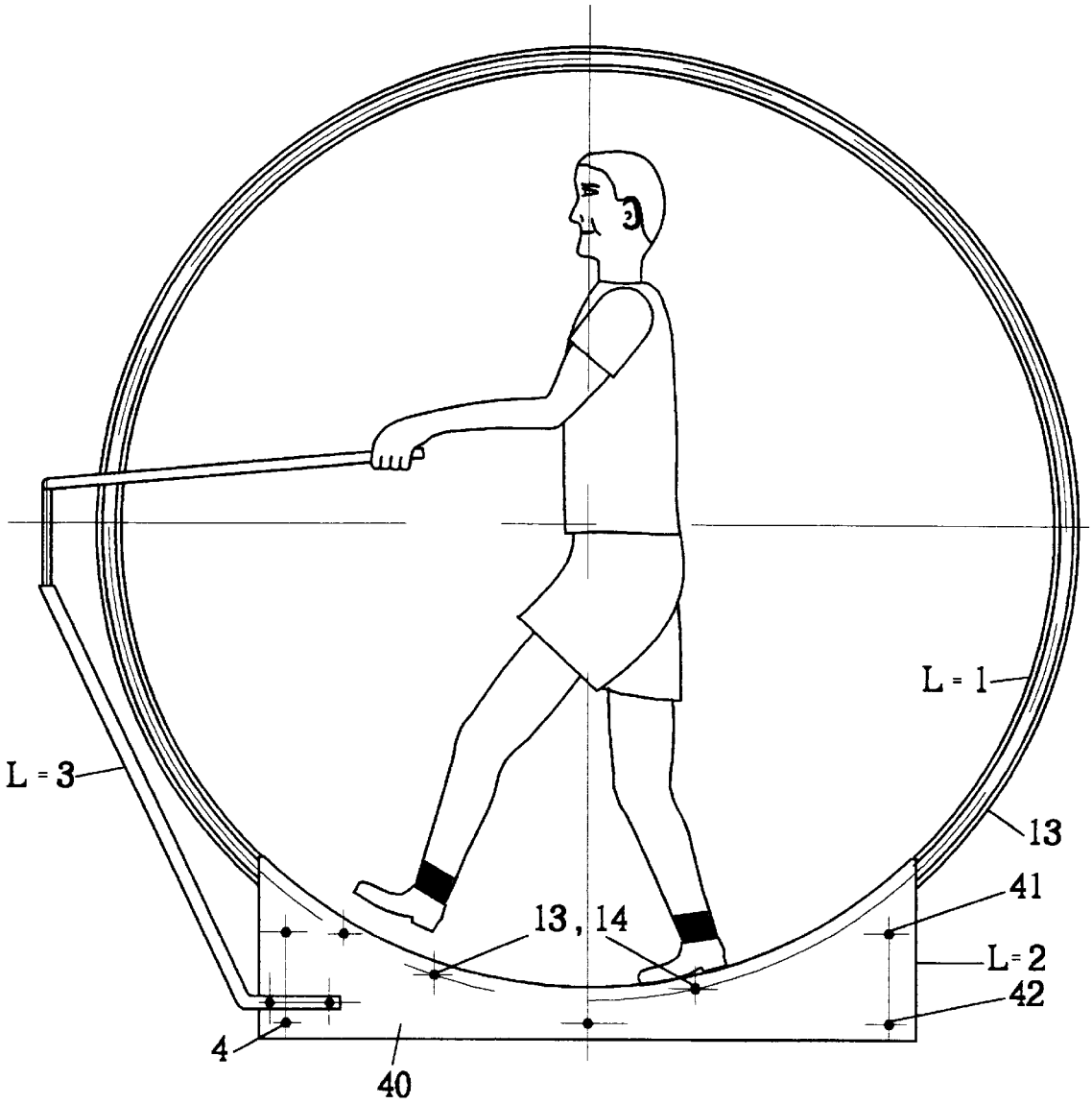
FIG. 7 illustrates the hoop as a training implement.
Figure 8:
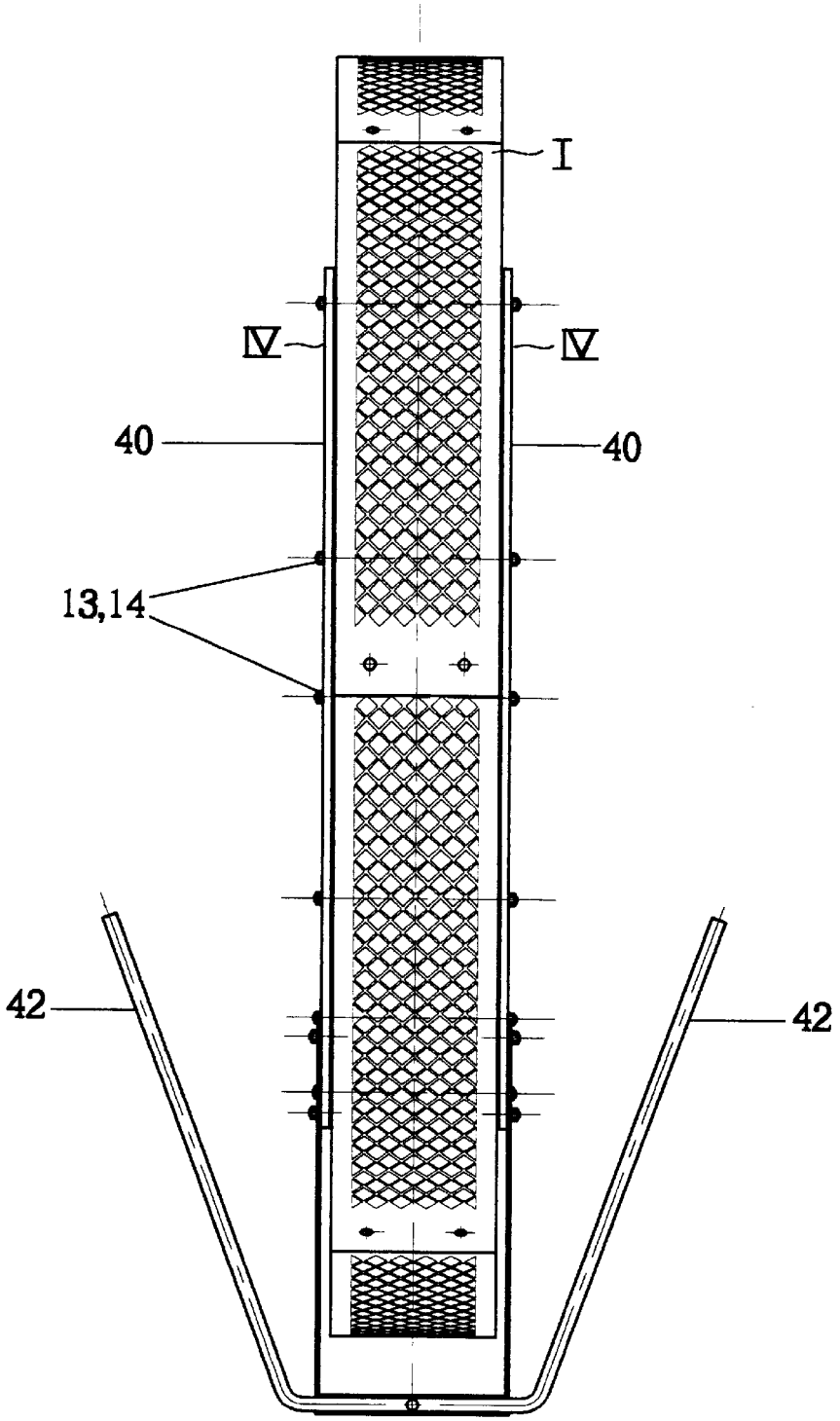
FIG. 8 is a top view of the implement of FIG. 7, FIG. 9 show another embodiment of the training implement enabling a person to actuate the hoop while seated.

FIGS. 7 and 8 illustrate a training implement utilizing the hoop described with reference to FIGS. 1 through 5 which, however should be of larger diameter to accommodate an adult person. There are known training implements in the form of an endless belt along which a person walks moving the belt against a variable resistance. The present implement works on the same principle, but it requires the person to mount along a slopping surface and revolving the hoop while it remains stationary. The hoop illustrated in FIG. 7 shows a circular recess which serves to secure the hoop in its base IV by means of rollers or roller bearings and bolts 13, 14. The base includes two side walls 40 held in position by cross bolts 41. An optional feature is two handle bars 42 attached to the base and extending towards the hands of the person exercising, on both sides of the hoop.

Figure 9:
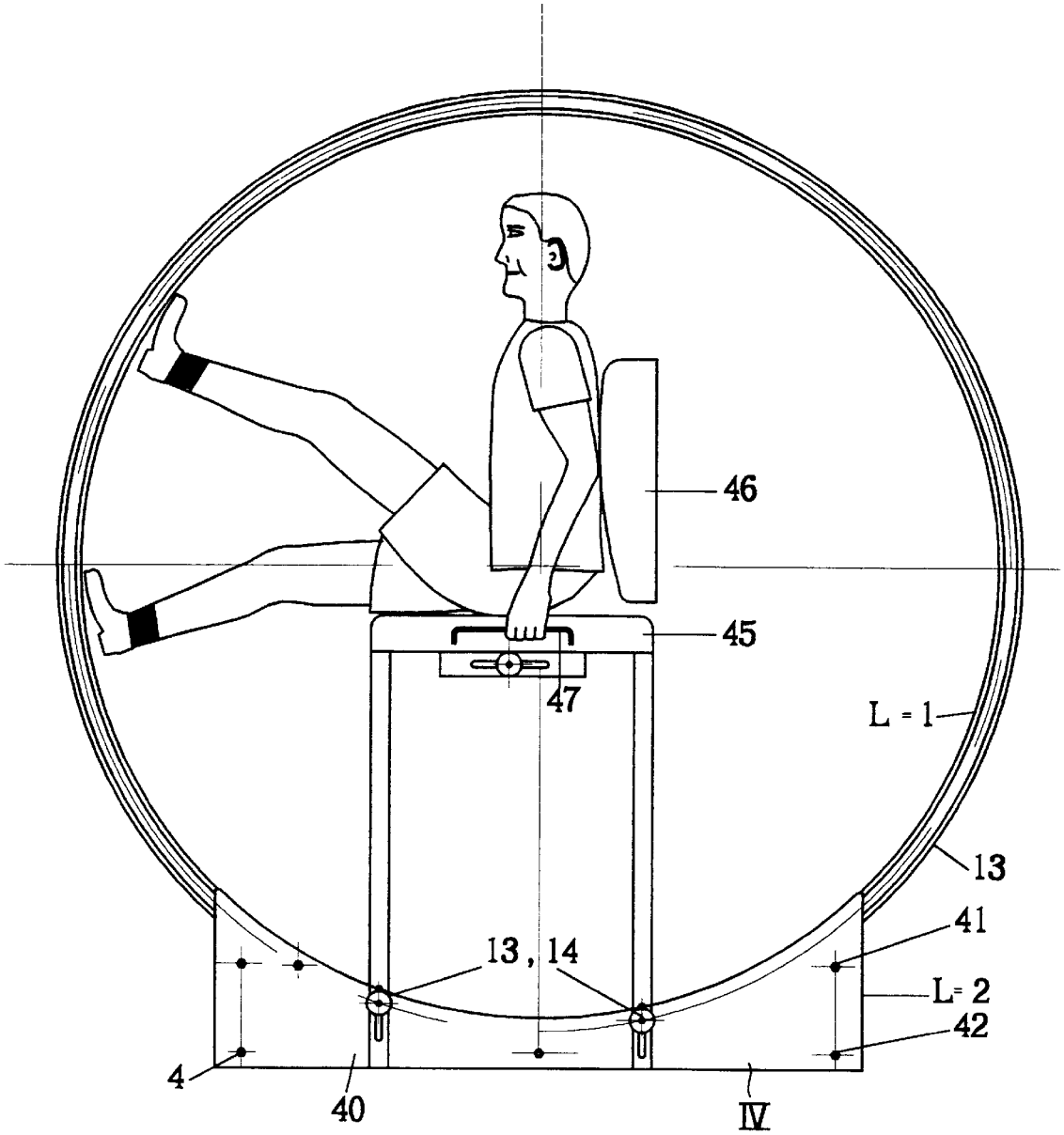
Figure 10:
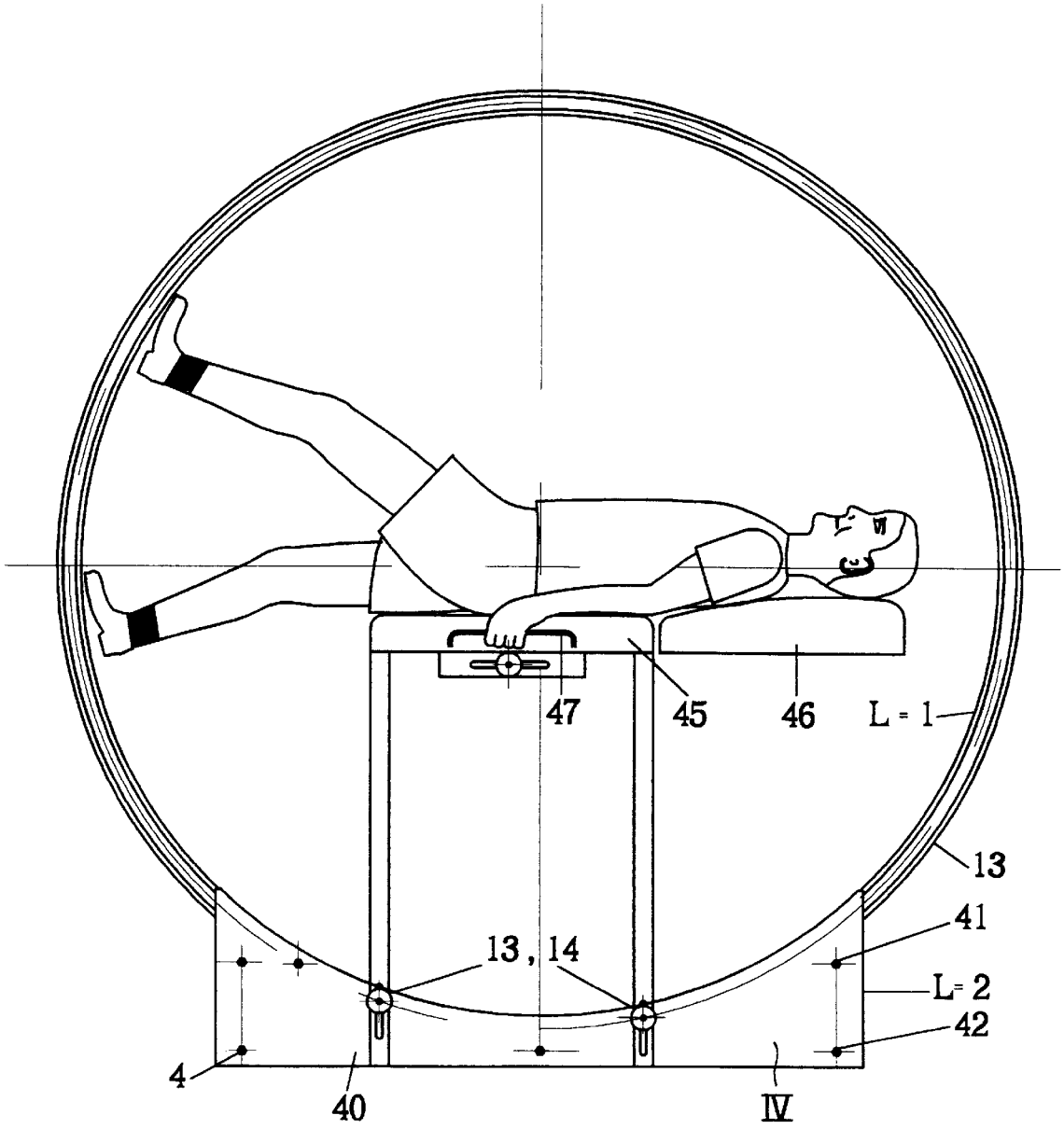
FIG. 10 shows the implement of FIG. 9 with a person actuating the hoop while lying.

FIGS. 9 and 10 illustrate the training implement adapted to being actuated by a person in sitting or lying state. It includes a seat 45 with backrest 46 firmly mounted on base IV, and the seat is provided with sides handles 47. The handles are to be gripped by the person either sitting or lying on the chair while his legs rotate the hoop while they are stretched out in horizontal direction.

Instead of securing the hoop to the base by means of the aforedecribed arrangement there may be a number of horizontal rollers mounted between side walls 40 on which the hoop can rest and revolve, and can be readily lifted off the base and disassembled into sections when not in use.

What is claimed is:

1. An implement for a child for training or playing and permitting the child to ride in the implement and to steer the implement, comprising:

a hoop having an inner diameter larger than the height of the child using the implement and of a width permitting said child to tread along its inside with both feet, said hoop having an inside portion including a central portion of smaller thickness than that of two lateral edge portions extending outwardly from said central portion, a chassis frame slidingly attached to said lateral edge portions of said hoop and supporting a front wheel attached to a lower end of an upright axle which is rotatably mounted in said chassis frame, and at least one steering handle attached to said upright axle and extending towards at least one hand of said child.

2. The implement of claim 1, wherein said chassis frame includes two pairs of struts extending to both sides of said lateral edges of said hoop.

3. The implement of claim 2, wherein said chassis frame is slidingly fastened to said hoop by means of at least four rollers or roller bearings firmly attached to said struts and slidingly inserted into circular recesses in both sides of said hoop.

4. The implement of claim 1, wherein said central portion of said hoop is perforated.

5. The implement of claim 4 wherein the perforation is in the form of a lattice.

6. The implement of claim 1, wherein said central portion of said hoop is solid.

7. The implement of claim 1, wherein said hoop comprises a plurality of sections connected to each other by tongues and grooves.

8. The implement of claim 1, wherein said hoop comprises a plurality of sections connected to each other by swallow tailed ends inserted into tapering slots.

9. The implement of claim 1, wherein said at least one steering handle comprises two handles attached to said upright axle and extending to both sides of said hoop towards the hands of said child.

10. The implement of claim 1, wherein said chassis frame is slidingly attached to said hoop by means of two pairs of rollers or roller bearings, each pair hugging one said lateral edge from the inside and the outside of said hoop.

11. The implement of claim 1, wherein said front wheel is mounted in a fork forming a lower end of said upright axle.

12. The implement of claim 1, wherein said inside portion of said hoop is smooth.

13. The implement of claim 1, wherein said inside portion of said hoop is a lattice.

14. A training implement for a person comprising:

a hoop having an inner diameter larger than the height of the person using said implement and of a width permitting said person to tread along its inside with both feet of said person, stationary base for slidingly supporting said hoop on rollers or roller bearings in a manner securing said hoop in position on said base and permitting its rotary motion caused by said person walking along its inside, and a seat attached to said base permitting a person to actuate said hoop in a sitting or lying state.

15. The implement of claim 14, wherein one hand grip is provided extending to one hand of said person and attached to said base by means of a bar.

16. The implement of claim 14, wherein two hand grips are provided extending to both hands of said person along both sides of said hoop and attached to said base.

17. A training implement for a person, the training implement comprising:

a hoop having an inner diameter larger than the height of the person using said implement and a width permitting said person to tread along its inside with both feet, said hoop having a smooth inside portion including a central portion of smaller thickness than that of two lateral edge portions extending outwardly from said central portion, a stationary base supported on a floor, the stationary base slidingly supporting said hoop on rollers or roller bearings so as to secure said hoop in position on said base and to permit rotary motion of said hoop, and a seat attached to said base, the seat permitting a person to actuate said hoop in a sitting or lying state.

* * * * *